US009554224B2

(12) United States Patent
Bern

(10) Patent No.: US 9,554,224 B2
(45) Date of Patent: Jan. 24, 2017

(54) HOLDING UNIT FOR A VIBRATION TRANSMITTER AND A VIBRATION TRANSMISSION SYSTEM USING IT

(71) Applicant: Oticon Medical A/S, Smørum (DK)

(72) Inventor: Bengt Bern, Möndal (SE)

(73) Assignee: OTICON MEDICAL A/S, Smorum (DK)

( * ) Notice: Subject to any disclaimer, the term of this patent is extended or adjusted under 35 U.S.C. 154(b) by 0 days.

(21) Appl. No.: 14/992,811

(22) Filed: Jan. 11, 2016

(65) Prior Publication Data

US 2016/0198272 A1 Jul. 7, 2016

Related U.S. Application Data

(63) Continuation of application No. 14/336,597, filed on Jul. 21, 2014, now Pat. No. 9,271,094.

(30) Foreign Application Priority Data

Aug. 14, 2013 (EP) ..... 13180481

(51) Int. Cl.
*H04R 25/00* (2006.01)

(52) U.S. Cl.
CPC ..... *H04R 25/606* (2013.01); *H04R 25/456* (2013.01); *H04R 25/604* (2013.01); *H04R 25/65* (2013.01); *H04R 2225/67* (2013.01); *H04R 2460/13* (2013.01)

(58) Field of Classification Search
CPC ..... H04R 25/606; H04R 2460/13; H04R 2225/67; H04R 2225/025
USPC ..... 381/312, 322, 326, 151; 600/25; 601/46
See application file for complete search history.

(56) References Cited

U.S. PATENT DOCUMENTS

2007/0053536 A1 3/2007 Westerkull
2013/0018218 A1* 1/2013 Haller ..... H04R 25/60 600/25

FOREIGN PATENT DOCUMENTS

EP 2403271 A1 1/2012
EP 2592848 A1 5/2013
WO WO 2007/024657 A2 3/2007
WO 202009003507 U1 7/2009
WO WO 2012/160542 A 11/2012
(Continued)

OTHER PUBLICATIONS

European Search Report for EP 13180481.7 completed on Jan. 7, 2014.

*Primary Examiner* — Sunita Joshi
(74) *Attorney, Agent, or Firm* — Birch, Stewart, Kolasch & Birch, LLP

(57) ABSTRACT

A holding unit and a vibration transmission system are disclosed. The holding unit comprising a holding plate is configured to be attached to the skin by means of magnetic attraction between a number of external magnets that are either:
a) integrated within the holding plate;
b) mechanically attached to the holding plate; or
c) constituting the holding plate
and a number of internal magnets implanted under the skin of a hearing impaired person. The holding unit comprises a transmission member or plate member configured to transfer mechanical vibrations from a vibrator through the skin to the bone of the person. The transmission member or plate member is interconnected by a mechanical flexible coupling to the magnet(s) of the holding plate.

12 Claims, 9 Drawing Sheets

(56) References Cited

FOREIGN PATENT DOCUMENTS

WO WO 2013/096559 A1 6/2013

* cited by examiner 42
18
S
8
N
48
46
56
22
40
20
48
18
S
8
N
M
X
Y
Z 42
18
8
N
S
44
46
22
40
44
18
8
N
S 42
18
8
N
S
20
46
22
40
20
18
8
N 18
20,44,48
22
46

18
20,44,48
22
46

18
20,44,48
22
46

18
20,44,48
22
46

HOLDING UNIT FOR A VIBRATION TRANSMITTER AND A VIBRATION TRANSMISSION SYSTEM USING IT

This application is a Continuation of copending application Ser. No. 14/336,597, filed on Jul. 21, 2014, which claims priority under 35 U.S.C. §119(a) to Application No. EP 13180481.7, filed in Europe on Aug. 14, 2013, all of which are hereby expressly incorporated by reference into the present application.

FIELD

The disclosure generally relates to a holding unit for a vibration transmitter. In order to provide hearing impaired persons a sensation of sound, a vibrator may be pressed against the skin and vibrations transmitted to the underlying skull bone and trough the bone to the cochlear. In the cochlear the vibrations are perceived as sound by the hearing impaired person.

BACKGROUND

It is known to maintain pressure between the skin and the vibrator output element by means of magnets/magnetisable parts implanted subcutaneously and in the vibrator output part respectively. However, the constant pressurisation of the skin between the implanted parts and the vibrator may cause pressure wounds or irritation of the skin.

The prior art transcutaneous vibration transmission systems applies a relatively large plate with magnets facing the skin. This relatively large plate will act as a speaker membrane that will acoustically emit sound. This acoustical sound path has negative effects on feedback margins for the hearing aid system. This relatively large plate will have a relatively large mass that will create a mechanical impedance mismatch when transferring mechanical vibrations from the vibrator through the skin to the bone.

US 20130018218 A1 suggests several solutions to the problem (pressure wounds or irritation of the skin) of the constant pressurisation of the skin between the implanted parts and the vibrator: such as ameliorate the attraction power between external and internal parts by adjusting the distance between the skin surface and the external magnetic parts, or such as adding a soft cushioning layer between the magnetic parts and the skin or molding the parts abutting the skin by to follow the skin surface.

US 20130018218 A1 does not provide a solution to the problems caused by the transmission of the vibrations through the rather heavy magnets provided between the vibrator output and the skin surface.

Thus there is need for a transcutaneous vibration transmission system that reduces or even eliminates these drawbacks of the prior art.

SUMMARY OF THE INVENTION

The implementation is achieved by a holding unit as defined in claim 1 and by a vibration transmission system as defined in claim 11. Preferred embodiments are defined in the dependent sub claims and explained in the following description and illustrated in the accompanying drawings.

A transcutaneous vibration transmission system that improves the feedback margins for the hearing aid system using the vibration transmission system is disclosed. A transcutaneous vibration transmission system that may reduce the mechanical impedance mismatch during transfer of mechanical vibrations from a vibrator through the skin to the bone is disclosed.

The holding unit according to an aspect of disclosure is a holding unit comprising a holding plate configured to be attached to the skin by means of magnetic attraction between a number of external magnets that are either:

a) integrated within the holding plate;

b) mechanically attached to the holding plate or c) constituting the holding plate, and a number of internal magnets implanted under the skin of a hearing impaired person, wherein the holding unit comprises a transmission member or plate member configured to transfer mechanical vibrations from a vibrator through the skin to the bone of the person. The transmission member or plate member is interconnected by a mechanical flexible coupling to the magnet(s) of the holding plate.

Hereby it is possible to reduce the mechanically coupling between the holding plate and the transmission member or plate member and hereby create better impedance match between the transmission member or plate member and the bone and to reduce the feedback path.

The flexible mechanical coupling allows the vibration transmission part of the vibrator to transmit vibrations into the skin without transmitting more than a fraction of the vibrations into the external magnets at the same time.

The external magnet and the transmission member or the plate member which functions as a vibration transmission part, are configured to be placed side by side, with the external magnet arranged adjacent to/over an internal magnet. The transmission member or plate member and the external magnet are connected to each other; however, the connection between them is flexible, and comprises impedance relief means so that the vibrations of the vibration transmission part are only partially transmitted to the external magnet or magnetic means.

The impedance relief means may comprise springs, soft polymer or a similar compliant material, which allows the external magnet and the transmission member or plate member some relative movement, but at the same time hold the two parts together.

The external magnet(s) in the holding plate may constitute the holding plate itself. In this way, the magnet(s) are coupled directly to the transmission member or the plate member by a flexible coupling.

It is may be preferred that the holding unit comprises a housing or holding plate in which a number of (external) magnets are provided and that the holding unit moreover comprises a transmission member or plate member that is interconnected by a flexible coupling to the magnet(s) of the housing or the holding plate or that the holding unit moreover comprises a transmission member or plate member that is interconnected by a flexible coupling to the housing or the holding plate.

It may be useful that the flexible coupling comprises a mechanical connection with a spring property and a damping property. Hereby it is possible to reduce the mechanical coupling between the holding plate and the transmission member or plate member. By the term "spring property and a damping property" is meant that the mechanical properties of the connection basically corresponds to a spring and a vibration-damping member.

It may be also be useful that the flexible coupling is a material being significantly softer and more flexible than the material of the transmission member or the plate member.

The use of connection which is 3 times softer or three times more flexible than the flexibility of the transmission member or the plate member, makes it possible to ensure that the major fraction of the vibrations are transmitted from the transmission member or the plate member into the skin without transmitting more than a minor fraction of the vibrations into the skin through the holding plate.

It may be beneficial that the flexible coupling comprises a polymer body that forms a mechanical interface to both the transmission member or plate member and the magnet(s) of the holding plate.

Hereby a simple, robust and reliable holding unit can be manufactured.

It may be useful that the external magnet(s) comprise an array of individual magnets provided circumferential to the transmission member or plate member and that and that the internal magnet(s) comprise an array of individual magnets provided circumferential to the transmission member or plate member.

Such embodiment is simple and reliable and is easy to produce.

It may be beneficial that the flexible coupling comprises a body arranged circumferentially with respect to the transmission member or plate member, whereby the individual magnets are provided in a housing or holding plate arranged circumferentially with respect to the polymer body.

It may be useful to have a holding unit where three or more spaced apart individual magnets are provided basically evenly spaced in the housing or holding plate.

Hereby a firm and reliable attachment of the holding unit to the skin can be provided. By distributing the magnets evenly the magnetic attraction forces will be distributed in a desirable (and symmetric) way.

It may be useful that the magnets of the holding plate are individually adjustable in a direction toward and away from a surface of the housing or holding plate.

Hereby it is possible to adjust the magnetic attraction between the (magnets of the) holding unit and the interior magnets simply by screwing/rotating the magnet(s).

It may be also be useful that the holding unit comprises a housing provided with a threaded bore into which one or more threaded magnets are rotably mounted, so that the distance from the magnet(s) to the opening of the bore may be changed by turning the magnet(s).

The disclosed implementation may be achieved by a vibration transmission system comprising a holding unit according to one of the claims 1-10, a hearing aid device comprising a vibrator mechanically connected to the transmission member or plate member by means of a vibration member.

It is preferred that the vibration transmission system is a vibration transmission system, in which a microphone, a signal processor and a battery is provided in a housing, whereby said housing further accommodates the vibrator, and the vibrator is in operational engagement with a proximal end of a rod which extends outside the housing and wherein said rod at a distal end thereof is detachably coupled to the housing or the holding plate.

DESCRIPTION OF THE DRAWINGS

The invention will become more fully understood from the detailed description given herein below. The accompanying drawings are given by way of illustration only, and thus, they are not limitative of the present invention. In the accompanying drawings.

DETAILED DESCRIPTION OF THE INVENTION

Figure 1:
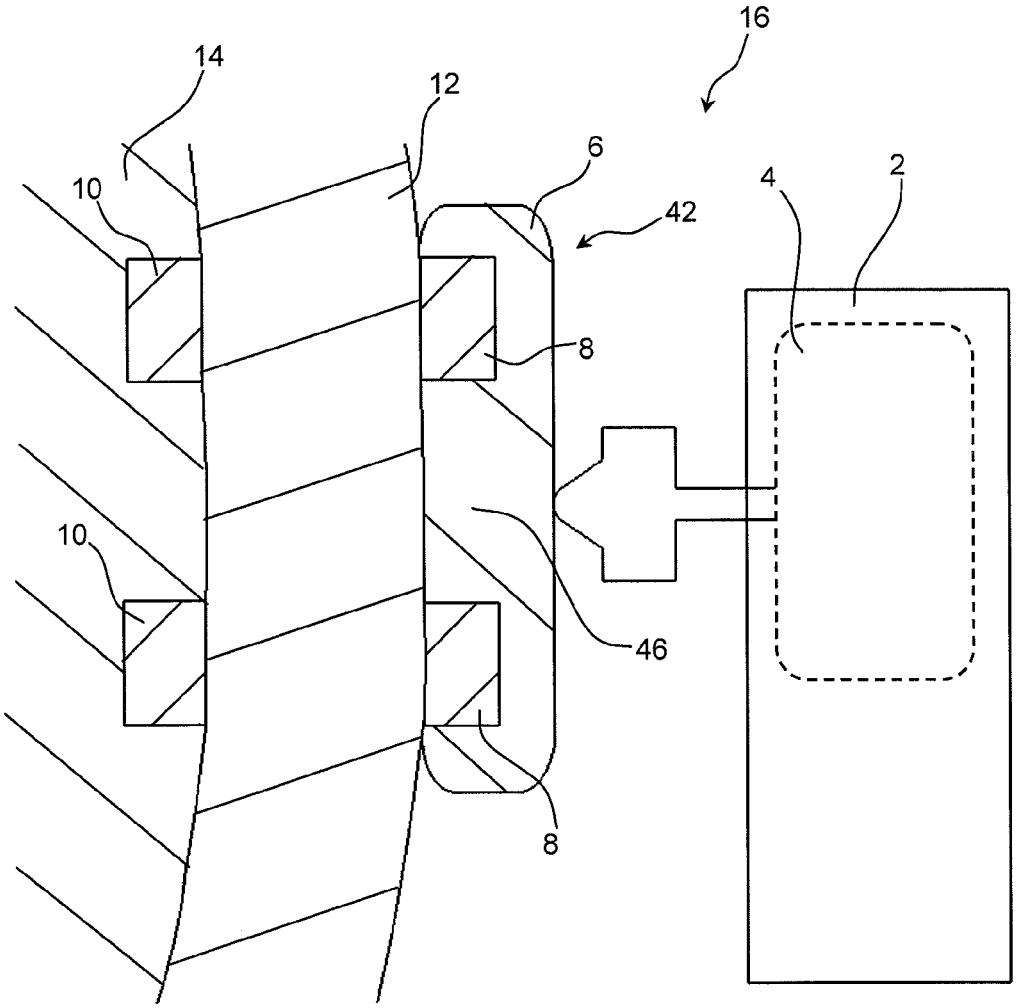
Prior art Fig. 1
FIG. 1 shows a prior art transcutaneous bone conductive hearing aid system comprising a hearing aid device and an implant according to an aspect of the disclosure.

Referring now in detail to the drawings for the purpose of illustrating different aspects of the disclosure, different views of a holding unit 42 according to the invention is illustrated in FIG. 2-7 while a prior art holding unit 42 is illustrated in FIG. 1 for comparison purposes.

FIG. 1 illustrates a cross-sectional view of a prior art hearing aid system 16. The hearing aid system 16 consists of a holding unit 42 having a large holding plate 6 consisting of permanent magnets 8 arranged in such a way that they are configured to facing and bearing against the skin 12 of a user that has an implanted magnet 10 under the skin 12 for attachment of the holding unit 42.

The hearing aid system 16 also consists of a hearing aid device 2 consisting of a vibrator 4 that is adapted to generate and transmit vibrations via a transmission member 46 to the underlying skull bone 14 and through the bone to the cochlear. In the cochlear, the vibrations are perceived as sound by the hearing impaired person.

The holding plate 6 is configured to act as a speaker membrane that will acoustically emit sound. This acoustical sound path will have negative effects on feedback margins for the hearing aid system 16, and it would be beneficial to reduce the feedback path.

The holding plate 6 typically has a relatively large mass that will create a mechanical impedance mismatch when trying to transfer the mechanical vibrations from the vibrator 4 through the skin 12 to the bone 14. Thus, it would be an beneficial to create better impedance match between the holding plate (that also function as vibratory plate) and the bone 14.

Figure 2:
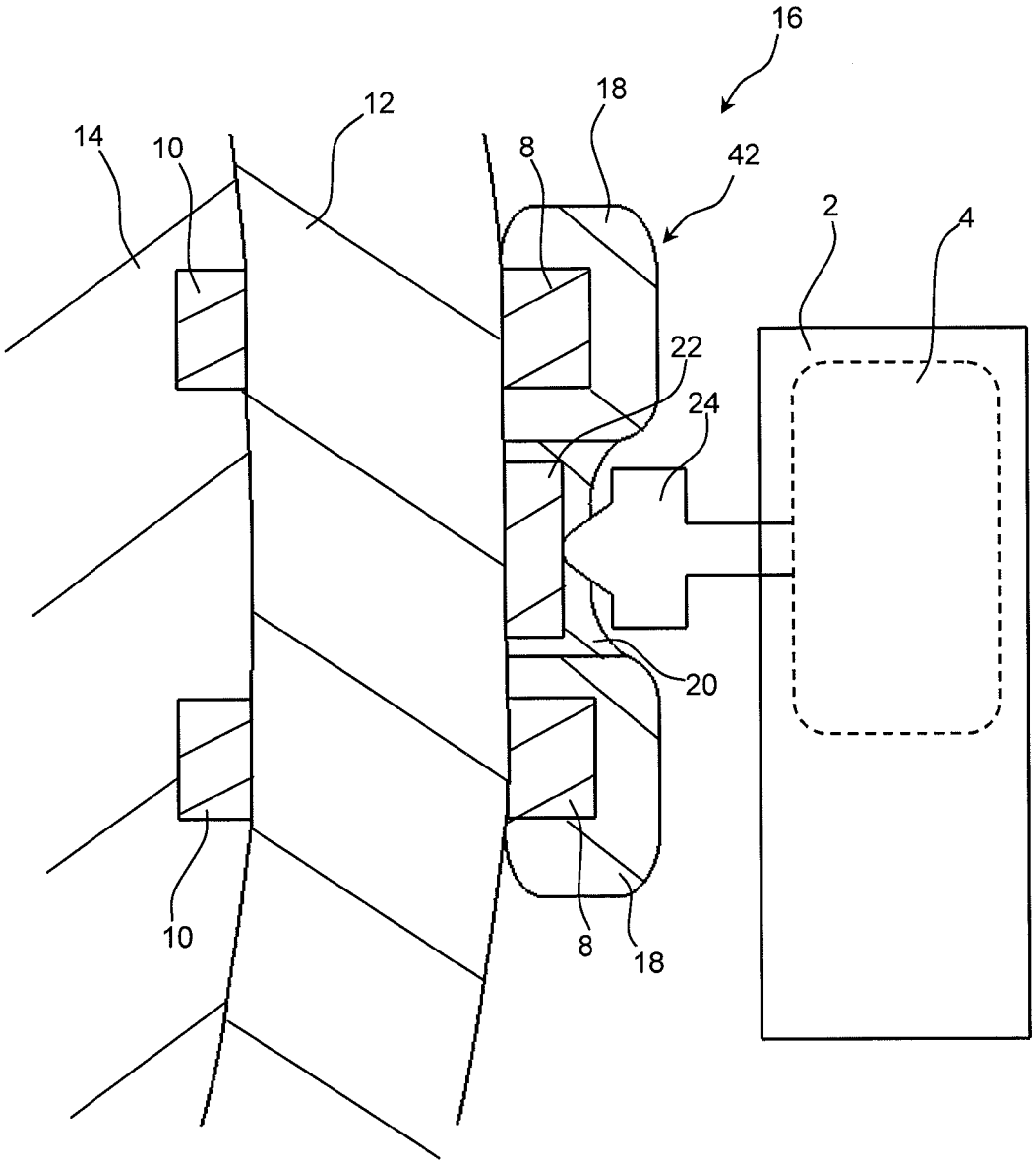
FIG. 2 shows a transcutaneous bone conductive hearing aid system according to an aspect of the disclosure.

FIG. 2 illustrates a cross-sectional view of a transcutaneous bone conductive hearing aid system 16 according to an aspect of the disclosure. The hearing aid system 16 is designed to solve the problems associated with the prior art holding unit 42 shown in FIG. 1.

The hearing aid system 16 comprises a holding unit 42 that has a holding plate 18 that is mechanically "separated" from the plate member 22 that is adapted to transmit vibrations through the skin 12 to the underlying skull bone 14 and trough the bone 14 to the cochlear.

Permanent magnets 8 are integrated within the holding plate 18 of the holding unit 42. The holding plate 18 comprises permanent magnets 8 that are arranged in such a way that they are configured to face and bear against the skin 12 of a user that has an implanted magnet 10 under the skin 12 for attachment of the holding unit 42.

The holding plate 18 is mechanically "separated" from the plate member 22 by using a soft material 20 that is provided between the holding plate 18 and the plate member 22. The soft material 20 connects the holding plate 18 and the plate member 22. However, the flexibility of the material 20 significantly reduces the mechanical coupling between the holding plate 18 and the plate member 22. Accordingly, the holding plate 18 will vibrate much less compared to the prior art hearing aid system 16 shown in FIG. 1, in which the holding plate 6 and the vibrator plate 6 is one "stiff unit".

By providing a relatively soft material 20 between the holding plate 18 and the plate member 22 (the vibratory plate unit) and at the same time providing the plate member 22 in a relative stiff material, it is possible to "partly disconnect" the weight of the holding plate 18 and the plate member 22.

The hearing aid system 16 further comprises a hearing aid device 2 provided with a vibrator 4 that is mechanically connected to the plate member 22 through a vibration member 24. When the vibrator 4 is activated the vibrator 4 will vibrate the plate member 22, which will then vibrate the skin 12.

Due to the fact that there is a relatively soft connection provided by using a soft material 20, thinned down section 44 or o-ring connection 48 between the plate member 22 and the holding plate 18, the holding plate 18 will vibrate much less compared to the prior art hearing aid system 16 shown in FIG. 1. The O-ring connection 48 shown in FIG. 4C may display anisitropical behaviour, such that bending forces which are illustrated by curved arrow M will cause large displacement whereas shear stresses, illustrated by arrows X, Y and Z in various directions will not cause displacement the same amount of displacement.

The soft material 20 will isolate the holding plate 18 so that it will vibrate less and therefore radiate less sound. Accordingly, the hearing aid system 16 according to this aspect of the disclosure will have a larger feedback margin compared with the described prior art system.

The soft connection between the plate member 22 and the holding plate 18 ensures that the plate member 22 will vibrate with a greater amplitude due to the fact that the vibratory mass is much lower compared with described prior art systems. Because of the low stiffness of the skin 12, a larger amplitude can be provided by the plate member 22.

Figure 4C:
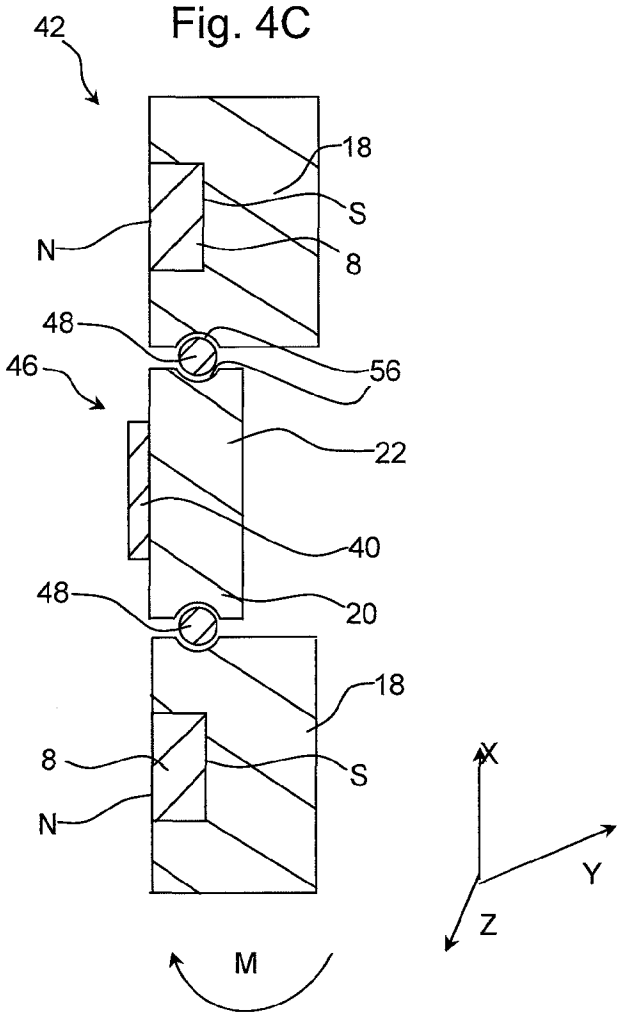
FIGS. 4A-4C illustrate different ways to implement impedance relief means according to three aspects of the disclosure.
Figures 9A, 9B, 9C, 9D:
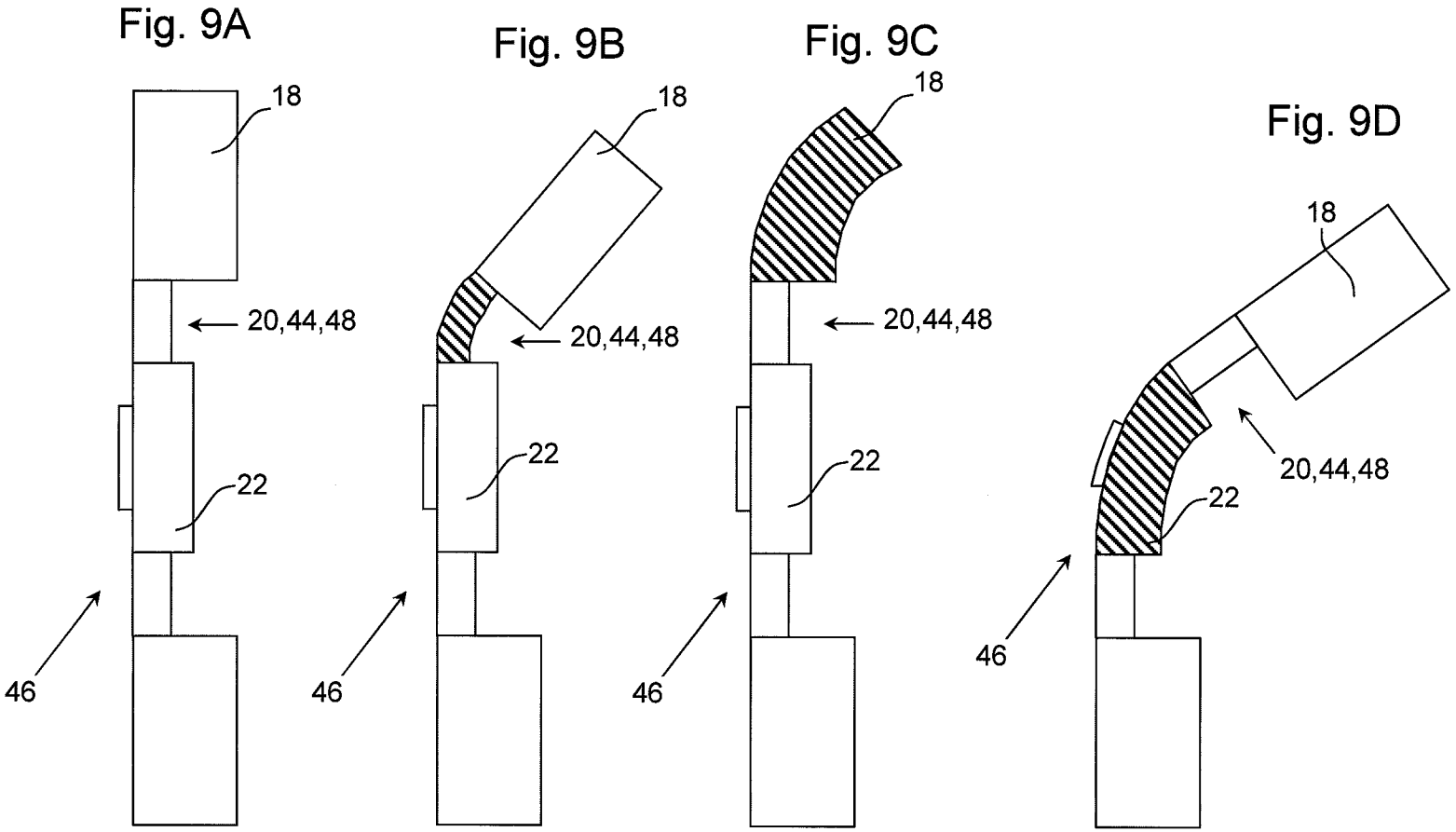
FIGS. 9A-9D show various bending modes of the parts abutting the skin according to aspects of the disclosure.

FIG. 9 shows how the various parts touching the skin may bend. In FIG. 4C the holding plate 18 bends and in FIG. 4D the plate member 22 bends, whereas in FIG. 4B it is the connection 20, 44, 48 between the two which bends. In order to achieve a vibrational de-coupling of the holding plate 18 from the plate member 22 the bending force required to bend the connection 20, 44, 48 should be at least 3 times smaller than the bending force required to cause a similar impact on the plate member 22 and the holding plate 18. This is achievable by use of softer material or thinned down parts for the connection 20, 44, 48.

Thus, the plate member 22 will have a better impedance match to the skin 12. Accordingly, the holding unit 42 according to the invention is able to provide a better transfer of vibrations from the vibrator through the skin 12 to the bone 14. Therefore, the holding unit 42 according to the invention will increase the sensitivity greatly of such a transcutaneous bone conduction system 16.

Figure 3A:
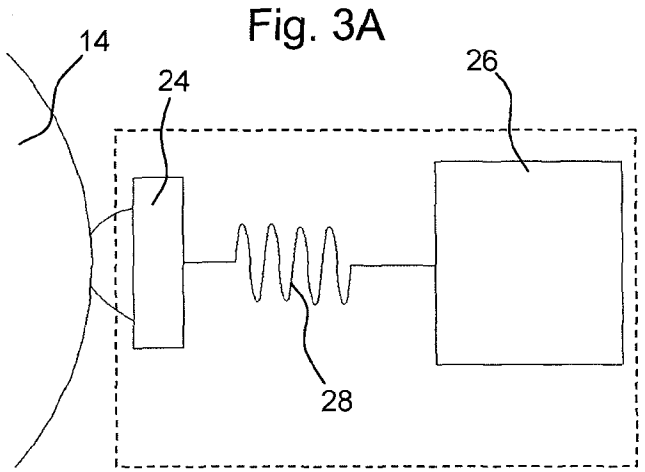
FIG. 3A shows a schematically view of a percutaneous system according to an aspect of the disclosure.

FIG. 3A illustrates a schematic view of a percutaneous system where a vibration member 24 bears against the head (skull 14) of a user. The system basically consists of two masses (the mass of the skull 12 and the active moving mass 26 of the vibrator) and one spring 28.

Figure 3B:
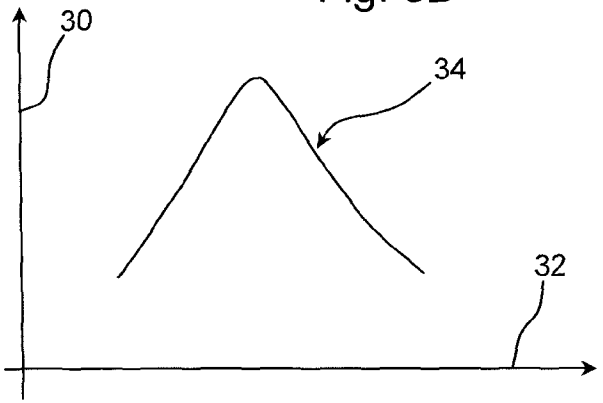
FIG. 3B shows a graph illustrating the sensitivity curve of the percutaneous system shown in FIG. 3 A) according to an aspect of the disclosure.

FIG. 3B is a graph 34 illustrating the sensitivity curve of the percutaneous system shown in FIG. 3A. The graph 34 depicts the sensitivity 30 as function of the vibration frequency 32. It can be seen from FIG. 3B that the system shown in FIG. 3A only gives rise to one resonance peak. The one resonance of this system can be determined by:

$$f_{res} = \frac{1}{2\Pi}\sqrt{\frac{k_{vib}}{m_{vib}}}, \tag{1}$$

where $f_{res}$ is the resonance frequency, $k_{vib}$ is the spring constant for the spring 28 and $m_{vib}$ is the mass 26.

Figure 3C:
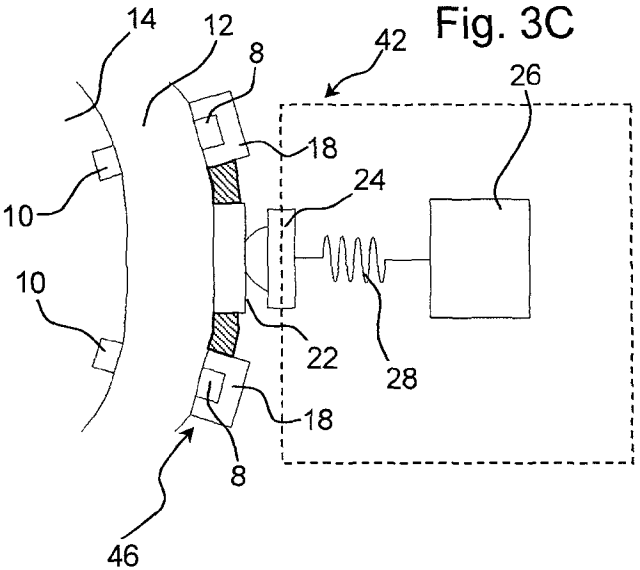
FIG. 3C shows a schematically view of a transcutaneous system according to an aspect of the disclosure.

FIG. 3C illustrates a schematic view of a transcutaneous system that comprises three masses (the mass of the skull 14, the active moving mass 26 of a vibrator and the mass of the transmission member 46) and two springs (the vibrator spring 28 and a "skin spring" (not shown) representing the characteristics of the skin 12).

The transcutaneous system comprises a holding unit 42 according to an aspect of the disclosure. The holding unit 42 comprises a plate member 22 through which vibrations are transmitted to the skull 14 via the skin 12. The holding unit 42 comprises a holding plate 18 configured to keep the plate member 22 attached to the skin 12. This is done by use of corresponding permanent magnets 8, 10 implanted under the skin 12 and in the holding plate 18.

Figure 3D:
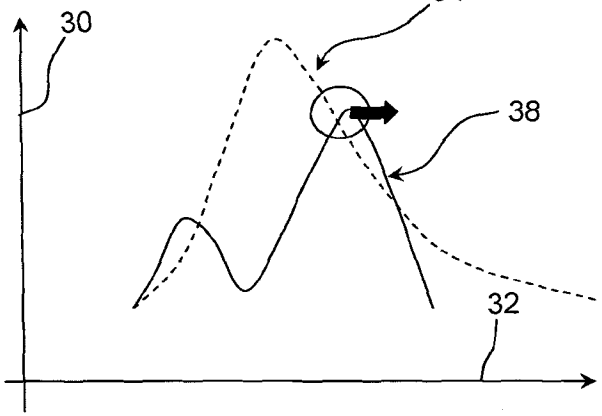
FIG. 3D shows a graph illustrating the sensitivity curve of the transcutaneous system shown in FIG. 3 C) according to an aspect of the disclosure.

FIG. 3D depicts the sensitivity 30 as function of the vibration frequency 32. The sensitivity curve 34 of the percutaneous system shown in FIG. 3A is shown with a dotted line, while the sensitivity curve 38 of the transcutaneous system shown in FIG. 3C is shown with a non-broken line.

It may be seen from FIG. 3D that the system shown in FIG. 3C gives rise to two resonance peaks. The right resonance peak frequency can be estimated by:

$$f_{res} = \frac{1}{2\Pi}\sqrt{\frac{k_{vib}}{m_{coupling}}}, \tag{2}$$

where $f_{res}$ is the resonance frequency, $k_{vib}$ is the spring constant for the spring 28 and $m_{coupling}$ is the moving mass i.e. the $m_{coupling}$ mass is the middle mass between the vibrator spring and the skin spring.

Figure 8:
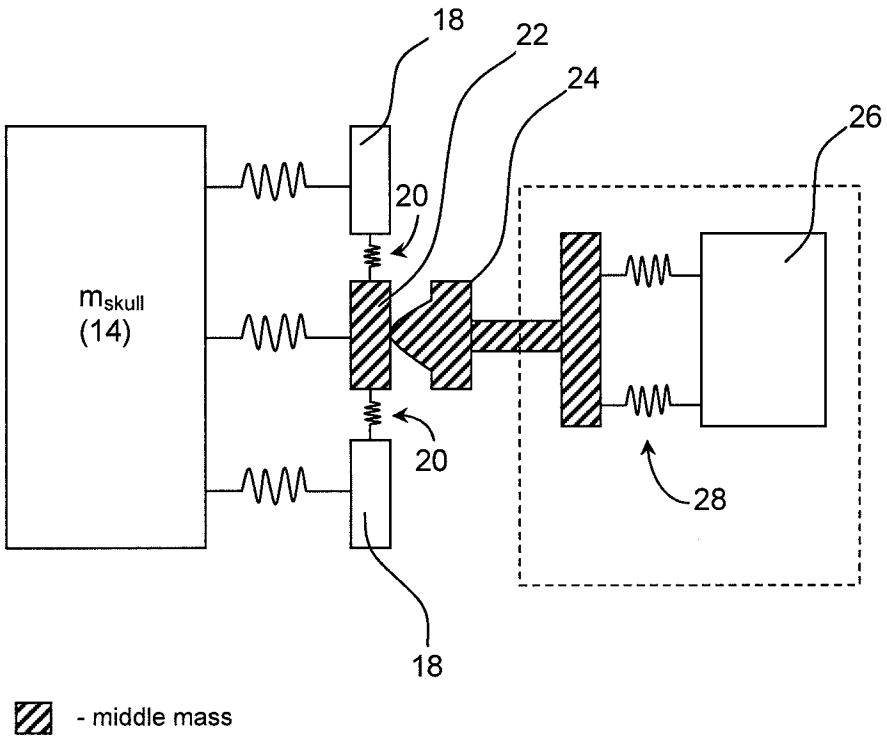
FIG. 8 is a schematic representation of the dynamics of the transcutaneous system according to an aspect of the disclosure.

In FIG. 8 the components which constitutes the $m_{coupling}$ mass are illustrated with a hatching signature. The fact that the holding plate 18 does not form part of the $m_{coupling}$ mass makes this mass less heavy compared to the prior art example of FIGS. 3A and 3B. The second left resonance peak is related to the skin spring constant in the total mechanical system.

As seen in the FIG. 3D the sensitivity curve 38 has a very large high frequency roll-off to the right of the right resonance peak. When the sensitivity curve 38 is compared to the dotted sensitivity curve 34 of the percutaneous system it can be seen that since this system has a large high frequency roll-off, it is desired to push (indicated with an arrow) the right resonance peak up to the highest possible frequency.

By reducing the weight of the moving mass ($m_{coupling}$), it is possible to increase the resonance frequency of this peak and minimize high frequency roll-off. The split up between the holding plate 18 and the transmission member 46 helps to keep $m_{coupling}$ low. Further, by reducing the surface area of the transmission member 46 it is possible to reduce the amplitude of the emitting sound waves from the transmission member 46. This will minimize the risk of feedback in the transcutaneous system as less sound is transmitted to the air.

FIG. 4 illustrates different ways to implement impedance relief means according to three aspects of the disclosure. FIG. 4 shows that it is possible to implement impedance relief means in different ways.

Figure 4B:
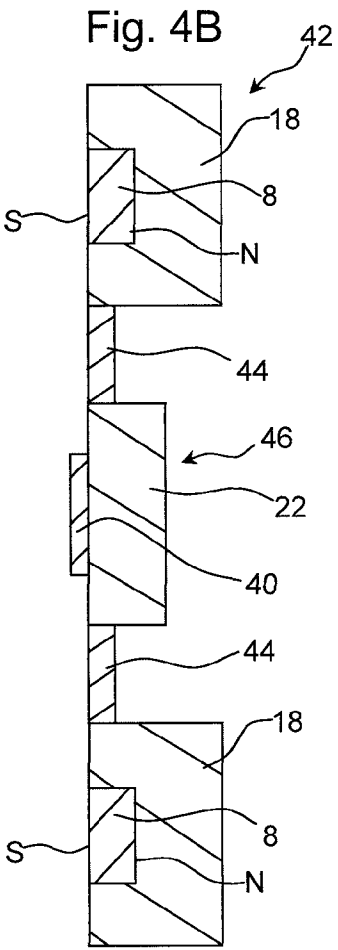
Figure 4A:
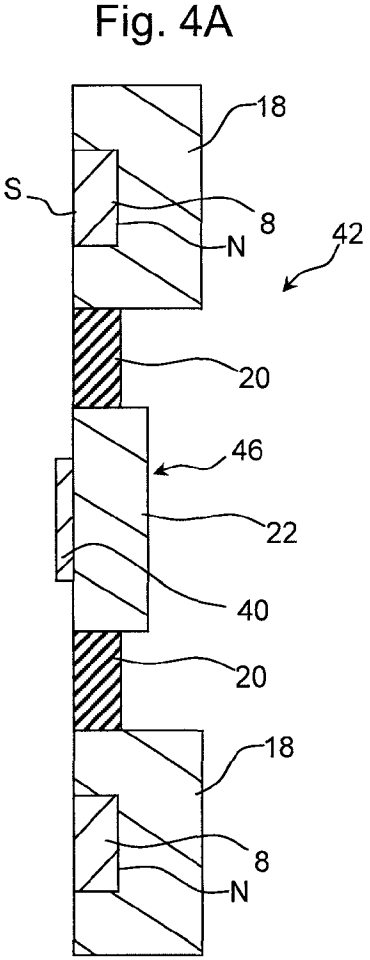

FIG. 4A is a schematic cross-sectional view of a holding unit 42 according to the invention. The holding unit 42 comprises a holding plate 18 with permanents magnets 8 having a north pole N facing the central area of the holding plate 18 and a south pole S arranged to face the north pole of an implanted magnet (see FIGS. 6-7).

The holding unit 42 comprises a transmission member 46 having a plate member 22 to which a protrusion member 40 is provided. The protrusion member 40 is provided as a protruding extension of the distal surface of the plate member 22. It is preferred that the plate member 22 is made of a material that is significantly stiffer than the soft material 20. The plate member 22 can, by way of example be made in a plastic material e.g. by an injection moulding process.

A soft material 20 is provided between the holding plate 18 and the plate member 22. Accordingly, the holding plate 18 will vibrate much less compared to the prior art hearing aid systems. The soft material 20 isolates the holding plate 18 in such a manner that the holding plate 18 will vibrate less and radiate less sound. Hereby a larger feedback margin can be achieved.

FIG. 4B is a schematic cross-sectional view of another holding unit 42 according to the invention. Like the holding unit 42 shown in FIG. 4 A) the holding unit 42 comprises a holding plate 18 with permanents magnets 8 each having a north pole N and a south pole S arranged in the same way.

Instead of a soft material (like in FIG. 4A, a thin member 44 is provided between the holding plate 18 and the plate member 22. The thin member 44 may be manufactured in the same material as the plate member 22. It is however, important, that the thin member 44 has thin walls compared with the plate member 22 like illustrated in FIG. 4B.

In this manner it is possible to significantly reduce the mechanical coupling between the holding plate 18 and the plate member 22. Accordingly, the holding plate 18 will vibrate much less compared to the prior art hearing aid systems.

By providing a thin member 44 between the holding plate 18 and the plate member 22 and at the same time providing the plate member 22 in a relative stiff material it is possible to "partly disconnect" the weight of the holding plate 18 and the plate member 22.

FIG. 4C is a schematic cross-sectional view of further holding unit 42 according to an aspect of the disclosure. Like the holding unit 42 shown in FIG. 4A and FIG. 4B the holding unit 42 comprises a holding plate 18 with permanents magnets 8 each having a north pole N and a south pole S, however, arranged in the opposite way.

O-rings 48 are provided between the holding plate 18 and the plate member 22. Hereby, it is possible to significantly reduce the mechanical coupling between the holding plate 18 and the plate member 22 so that the vibration of the holding plate 18 can be reduced.

By providing O-rings 48 between the holding plate 18 and the plate member 22 and at the same time providing the plate member 22 in a relative stiff material it is possible to "partly disconnect" the weight of the holding plate 18 and the plate member 22. It is possible to provide recesses 56 for receiving the O-rings 48 in the holding plate 18 and the plate member 22 as illustrated in FIG. 4C.

FIG. 5 illustrates ways of arranging the magnets 8 and a transmission member 46 of a holding unit 42 according to three aspects of the disclosure.

Figure 5A:
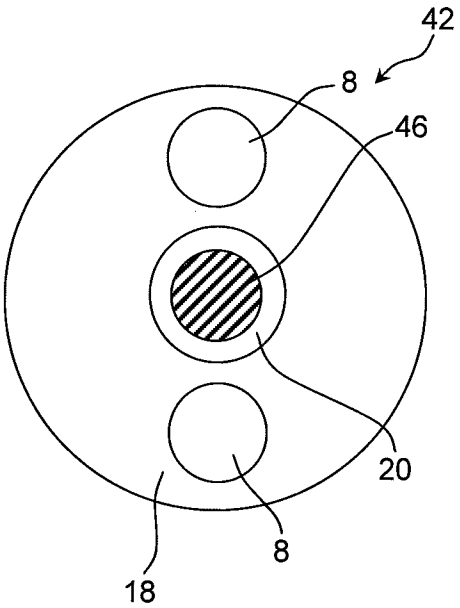
FIGS. 5A-5C show ways of arranging magnets and a transmission member of a holding unit according to three aspect of the disclosure.

FIG. 5A is a front view of a holding unit 42 according to an aspect of the invention. The holding unit 42 comprises a cylindrical holding plate 18 and a centrally arranged transmission member 46 (it may be a plate member 22 as shown in FIG. 2). Two cylindrical magnets 8 are arranged near the periphery of the holding unit 42. A ring-shaped member made in soft material 20 is provided between the transmission member 46 and the holding plate 18.

As explained with reference to FIG. 4A the soft material 20 provided between the holding plate 18 and the plate member 22 isolates the holding plate 18 in such a manner that the holding plate 18 will vibrate less and radiate less sound so that a larger feedback margin can be achieved.

Figure 5B:
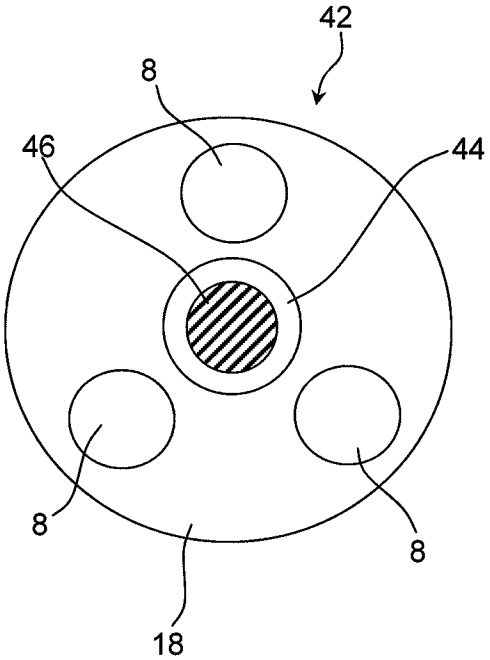

FIG. 5B is a front view of another holding unit 42 according to the invention. The holding unit 42 comprises a cylindrical holding plate 18 and a centrally arranged transmission member 46 shaped as a plate member as shown in FIG. 2. Three cylindrical magnets 8 are evenly distributed along the periphery of the holding unit 42. A ring-shaped member made as a thin member 44 is provided between the transmission member 46 and the holding plate 18.

As explained with reference to FIG. 4B it is possible to significantly reduce the mechanical coupling between the holding plate 18 and the plate member 22 by providing a thin ring-shaped member 44 between the transmission member 46 and the holding plate 18. Thus, the holding plate 18 will vibrate much less compared to the prior art hearing aid systems. The holding plate 18 will radiate less sound so that a larger feedback margin can be achieved.

Figure 5C:
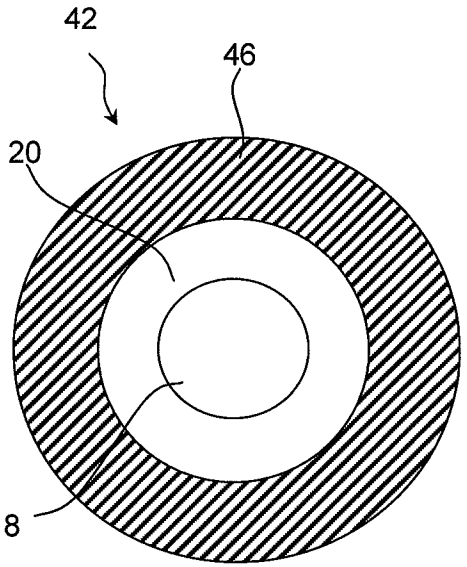

FIG. 5C is a front view of a further holding unit 42 according to the invention. The holding unit 42 comprises a cylindrical and centrally arranged magnet 8 and a concentrically arranged cylindrical transmission member 46. A soft material 20 is provided between the transmission member 46 and the magnet 8.

The soft material 20 provided between the transmission member 46 and the magnet 8 isolates the transmission member 46 in such a manner that the transmission member 46 will vibrate less and radiate less sound so that a larger feedback margin can be achieved.

Figure 6B:
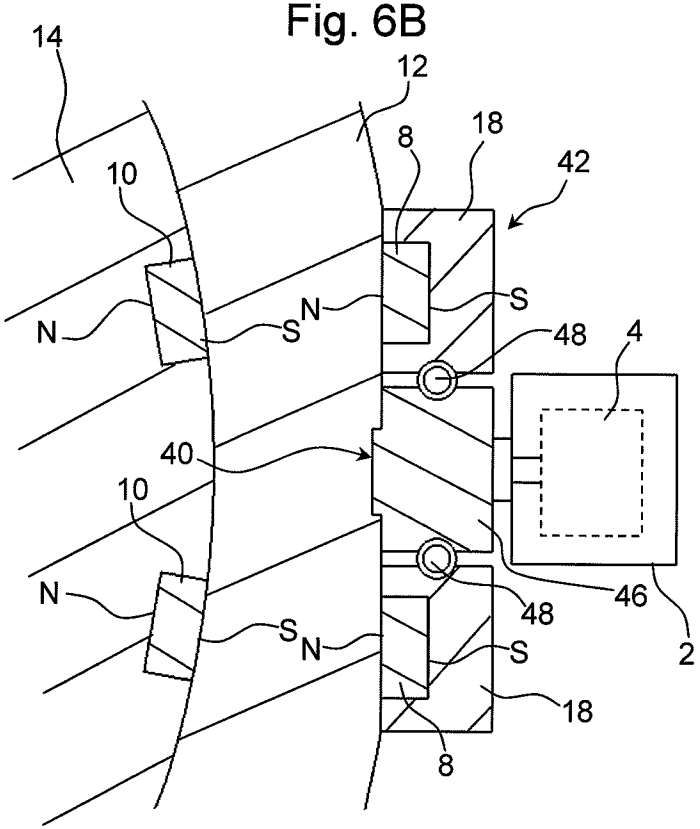
FIG. 6B shows a holding unit in which the transmission member has a protrusion member according to an aspect of the disclosure.
Figure 6A:
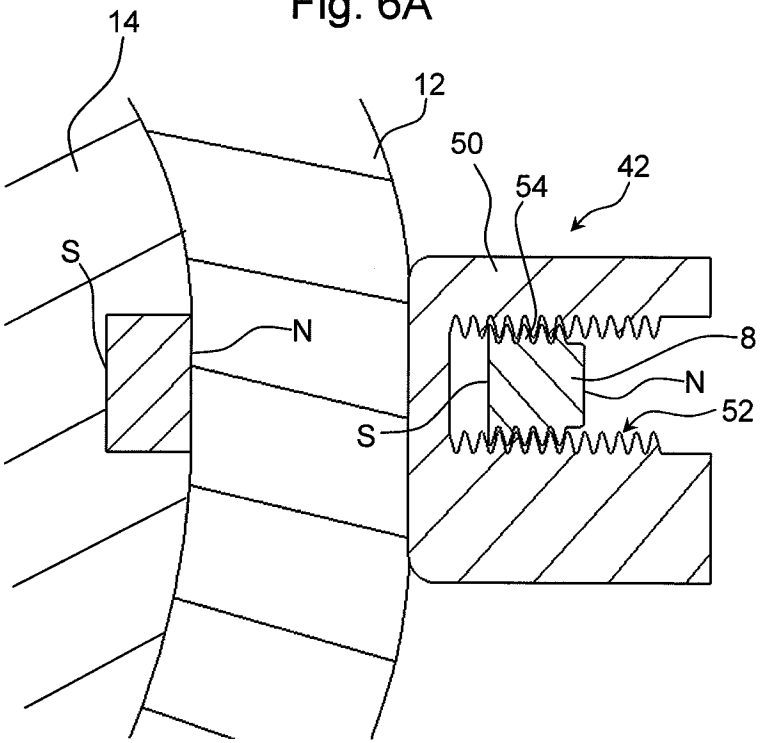
FIG. 6A shows a cross-sectional view of a holding unit configured to adjust the magnetic attraction force according to an aspect of the disclosure.

FIG. 6A illustrates a cross-sectional view of a holding unit 42 according to an aspect of the disclosure. The holding unit 42 comprises a housing 50 provided with a threaded bore. The thread 52 of the bore corresponds to the thread 54 of a magnet 8. The magnet 8 has a north pole N facing the opening of the bore and a south pole S facing the bottom of the bore.

The holding unit 42 is configured to adjust the magnetic attraction force by turning the magnet 8 and hereby changing the distance between the magnet 8 and an implanted magnet 10 provided under the skin 12 of the user of the hearing aid system for which the holding unit 42 is configured to be used.

The implanted magnet 10 is arranged with the south pole S facing the north pole of the magnet 8 of the holding unit 42. Hereby, the holding unit 42 can be attached to the skin 12 of the user by means of magnetic attraction.

FIG. 6B illustrates a cross-sectional close-up view of a holding unit 42 having a transmission member 46 provided with a protrusion member 40. The protrusion member 40 is adapted to transmit vibrations to the underlying skull bone 14 and trough the bone 14 to the cochlear. In the cochlear the vibrations are perceived as sound by the hearing impaired person.

The holding unit 42 comprises a holding plate 18 with integrated magnets 8 facing towards and bearing against the skin 12 of a user having implanted magnets 10. The south poles S of the implanted magnets faces the north poles N of the magnets 8 of the holding plate 18.

The holding plate 18 is mechanically separated from the transmission member 46 by means of an O-ring 48 arranged between the holding plate 18 and the transmission member 46. A hearing aid device 2 comprising a vibrator is mechanically connected to the transmission member 46 and configured generate and transmit vibrations to the underlying skull bone 14 and trough the bone 14 to the cochlear.

FIG. 7 illustrates cross-sectional close-up view of parts of three holding units according to aspects of the disclosure. Each of the holding units comprises a holding plate 18 and a permanent magnet 8 that is integrated within the holding plate 18. Each of the holding units comprises a holding plate 18 comprising a permanent magnet 8 that is arranged in such a way that it is configured to face and bear against the skin 12 of a user that has an implanted magnet 10 under the skin 12 (attached to the bone 14) for attachment of the holding plate 18.

Figure 7B:
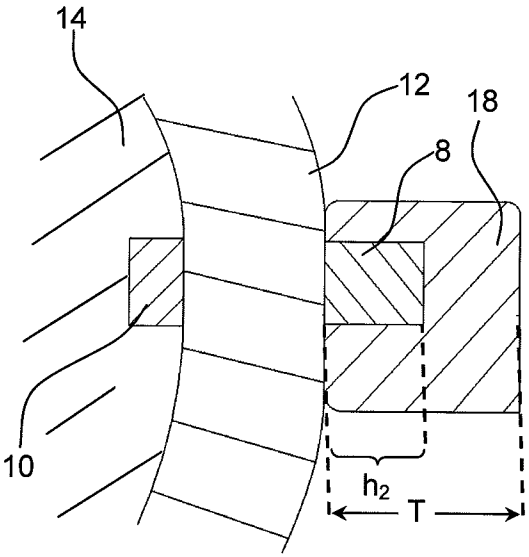
FIGS. 7A-7B show that the size of the magnets within the holding plate can vary according to an aspect of the disclosure.
Figure 7A:
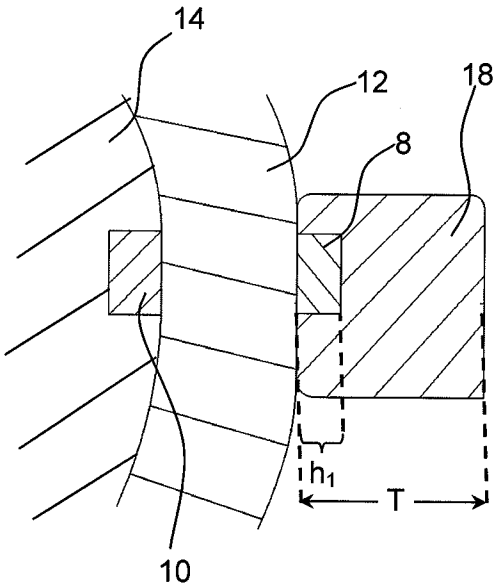

In FIG. 7A the permanent magnet 8 has a height $h_1$ that approximately corresponds to a fourth of the thickness T of the holding plate 18. Hereby, a relative small magnetic attraction force will be provided between the holding plate 18 and the implanted magnet 10.

In FIG. 7B the permanent magnet 8 has a height $h_2$ that approximately corresponds to half the thickness T of the holding plate 18. Hereby, a larger magnetic attraction force will be provided between the holding plate 18 and the implanted magnet 10.

Throughout the foregoing description, for the purposes of explanation, numerous specific details were set forth in order to provide a thorough understanding of the disclosure. The description is provided to enable any person skilled in the art to practice the various aspects described herein. It will be apparent, however, to one skilled in the art that the disclosure may be practiced without some of these specific details and various modifications, in compliance with the disclosed generic principle, to these aspects may be applied. All structural and functional equivalents to the elements of the various aspects described throughout this disclosure that are known to those of ordinary skill in the art are expressly incorporated herein by reference and are intended to be encompassed by the claims.

Accordingly, the scope should be judged in terms of the claims which follow.

LIST OF REFERENCE NUMERALS

2—Hearing aid device
4—Vibrator
6—Holding plate
8—Magnet
10—Magnet
12—Skin
14—Skull
16—Hearing aid system
18—Holding plate
20—Soft material
22—Plate member
24—Vibration member
26, $m_{vib}$, $m_{coupling}$—Mass
28—Spring
30—Sensitivity
32—Frequency
34, 38—Graph
40—Protrusion member
42—Holding unit
44—Thin member
46—Transmission member
48—O-ring
50—Housing
52, 54—Thread
56—Recess
S—South pole
N—North pole
$f_{res}$—Resonance frequency
$k_{vib}$—Spring constant
$h_1$, $h_2$, $h_3$—Height
T—Thickness

The invention claimed is:

1. A holding unit comprising an internal magnet configured to be implanted under skin of a hearing impaired person;

a holding plate configured to be attached to the skin by way of magnetic attraction between an external magnet and the internal magnet, the external magnet being configured to mechanically attach within holding plate and the external magnet comprises an adjusting unit configured to adjust the external magnet within the holding plate for changing the magnetic attraction between the external magnet and the internal magnet; and a transmission member configured to transfer mechanical vibrations from a vibrator through the skin to a bone of the person, wherein the holding plate comprises a threaded bore configured to receive the external magnet; and the adjusting unit of the external magnet comprises a threaded section configured to interact with the threaded bore of the holding plate such that turning the threaded section within the threaded bore changes the distance between the magnet and the internal magnet.

2. The holding unit according to claim 1, wherein adjusting the external magnet within the holding plate is along a thickness of the holding plate.

3. The holding unit according to claim 1, wherein the transmission member comprises a protrusion member that extends beyond a skin-facing surface of the transmission member and abuts the skin, the protrusion member being configured to transfer mechanical vibrations from a vibrator through the skin to a bone of the person.

4. The holding unit according to claim 3, wherein the protrusion member defines a section of skin facing surface of the transmission member, the section being directly opposite to a vibration member.

5. The holding unit according to claim 1, wherein an external magnet pole of the external magnet facing the skin is different from an internal magnet pole of the internal magnet facing towards the holding plate.

6. The holding unit according to claim 1, wherein the holding plate is mechanically separated from the transmission member by a flexible coupling arranged between the holding plate and the transmission member.

7. The holding unit according to claim 6, wherein the flexible coupling comprises an O-ring.

8. The holding unit according to claim 1, wherein the external magnet comprises an array of individual magnets provided circumferential to the transmission member and that the internal magnet comprise an array of individual magnets provided circumferential to the transmission member or plate member.

9. The holding unit according to claim 1, wherein the external magnet comprises a height that is selected from a group consisting of approximately one fourth of the thickness of the holding plate, or approximately half of the thickness of the holding plate, or same as the thickness of the holding plate.

10. A hearing aid system comprising a holding unit according to claim 1 and a hearing aid device comprising a vibrator mechanically connected to the transmission member by means of a vibration member.

11. The hearing aid system according to claim 9, wherein the hearing aid device comprises a microphone;

a signal processor; and a battery provided in a housing, wherein said housing further accommodates the vibrator, and the vibrator is in operational engagement with a proximal end of a rod that extends outside the housing and wherein the rod at a distal end thereof is detachably coupled to the housing.

12. The hearing aid system according to claim 9, wherein hearing aid system comprises a transcutaneous bone conduction hearing aid system.

* * * * *